US010067436B2

(12) United States Patent
Kobayashi

(10) Patent No.: US 10,067,436 B2
(45) Date of Patent: Sep. 4, 2018

(54) TWO-COMPONENT DEVELOPER

(71) Applicant: KYOCERA Document Solutions Inc., Osaka (JP)

(72) Inventor: Ryota Kobayashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/695,138

(22) Filed: Sep. 5, 2017

(65) Prior Publication Data

US 2018/0088480 A1 Mar. 29, 2018

(30) Foreign Application Priority Data

Sep. 29, 2016 (JP) ..... 2016-190914

(51) Int. Cl.

| | |
|---|---|
| ***G03G 9/08*** | (2006.01) |
| ***G03G 9/093*** | (2006.01) |
| ***G03G 9/097*** | (2006.01) |
| ***G03G 9/113*** | (2006.01) |
| ***G03G 9/10*** | (2006.01) |
| *G03G 9/087* | (2006.01) |
| *G03G 9/09* | (2006.01) |

(52) U.S. Cl.

CPC ..... *G03G 9/09392* (2013.01); *G03G 9/0825* (2013.01); *G03G 9/0975* (2013.01); *G03G 9/09741* (2013.01); *G03G 9/10* (2013.01); *G03G 9/113* (2013.01); *G03G 9/1138* (2013.01); *G03G 9/08755* (2013.01); *G03G 9/0918* (2013.01); *G03G 9/09357* (2013.01)

(58) Field of Classification Search

CPC ..... G03G 9/10; G03G 9/113; G03G 9/1138; G03G 9/09741; G03G 9/0975

USPC ..... 430/108.2, 111.1, 111.35, 111.4

See application file for complete search history.

(56) References Cited

FOREIGN PATENT DOCUMENTS

JP H10-198078 A 7/1998

*Primary Examiner* — Mark A Chapman

(74) *Attorney, Agent, or Firm* — Studebaker & Brackett PC

(57) ABSTRACT

A two-component developer includes a toner and a carrier. The toner is a positively chargeable toner that is positively charged by friction with the carrier. The toner includes a plurality of toner particles each including a toner mother particle and a plurality of first resin particles. An anionic surfactant having higher negative chargeability than the first resin particles is present on surfaces of the first resin particles. The carrier includes a plurality of carrier particles each including a carrier mother particle and a plurality of second resin particles. A cationic surfactant having higher positive chargeability than the second resin particles is present on surfaces of the second resin particles. The first resin particles have a zeta potential lower than 0 mV at a pH of 5. The second resin particles have a zeta potential higher than 0 mV at a pH of 5.

9 Claims, 1 Drawing Sheet

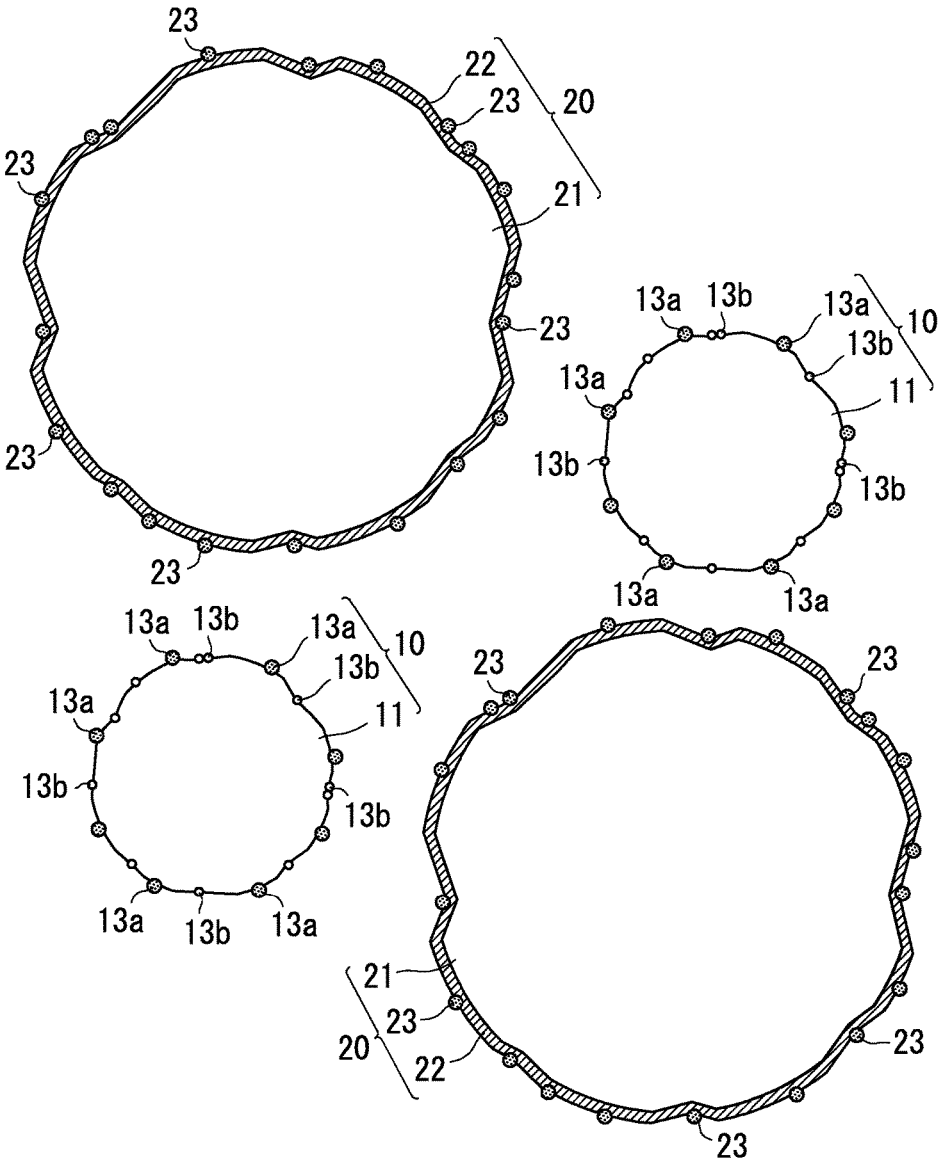
23
22
23
20
23
21
23
23
23
13a
13b
13a
10
13b
13a
11
13b
13b
13a
13a
13a
13b
13a
10
13b
13a
11
13b
13b
13a
13b
13a
23
23
21
23
20
22
23
23

TWO-COMPONENT DEVELOPER

INCORPORATION BY REFERENCE

The present application claims priority under 35 U.S.C. § 119 to Japanese Patent Application No. 2016-190914, filed on Sep. 29, 2016. The contents of this application are incorporated herein by reference in their entirety.

BACKGROUND

The present disclosure relates to a two-component developer containing a toner and a carrier.

It is a known technique in two-component developers to disperse resin fine particles and conductive fine particles in resin coat layers of carrier particles.

SUMMARY

A two-component developer according to the present disclosure includes a toner and a carrier. The toner is a positively chargeable toner that is positively charged by friction with the carrier. The toner includes a plurality of toner particles each including a toner mother particle and a plurality of first resin particles attached to a surface of the toner mother particle. An anionic surfactant having higher negative chargeability than the first resin particles is present on surfaces of the first resin particles. The carrier includes a plurality of carrier particles each including a carrier mother particle and a plurality of second resin particles attached to a surface of the carrier mother particle. A cationic surfactant having higher positive chargeability than the second resin particles is present on surfaces of the second resin particles. The first resin particles has a zeta potential lower than 0 mV at a pH of 5. The second resin particles has a zeta potential higher than 0 mV at a pH of 5.

BRIEF DESCRIPTION OF THE DRAWINGS

FIGURE illustrates a configuration of a two-component developer according to an embodiment of the present disclosure.

DETAILED DESCRIPTION

The following describes an embodiment of the present disclosure. Note that unless specifically stated, evaluation results (for example, values indicating shape and physical properties) of a powder (for example, toner mother particles, carrier mother particles, an external additive, a toner, and a carrier) are number averages of values measured with respect to an appropriate number of average particles selected from the powder.

Unless otherwise stated, the number average particle diameter of a powder is the number average value of equivalent circular diameters of primary particles of the powder (Heywood diameters: diameters of circles having the same areas as projected areas of the respective particles) measured using a microscope. A measured value of the volume median diameter ($D_{50}$) of a powder is a value measured using a laser diffraction/scattering particle size distribution analyzer ("LA-750" produced by Horiba, Ltd.), unless otherwise stated.

Chargeability refers to a chargeability in triboelectric charging, unless otherwise stated. A level of positive chargeability (or negative chargeability) in the triboelectric charging can be determined using for example a known triboelectric series.

In the following description, the term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof. Furthermore, the term "(meth)acryl" may be used as a generic term for both acryl and methacryl. In addition, the term "(meth)acrylonitrile" may be used as a generic term for both acrylonitrile and methacrylonitrile.

In the following description, "silica particles" refer to both non-treated silica particles and silica particles (surface-treated silica particles) obtained by surface treatment on a silica base (non-treated silica particles). Silica particles to which positive chargeability is imparted by surface treatment may be referred to as positively chargeable silica particles.

A two-component developer according to the present embodiment includes a toner and a carrier. The toner is a positively chargeable toner. The positively chargeable toner is positively charged by friction with the carrier. The toner and the carrier each are a powder including multiple particles. The toner includes a plurality of toner particles each having features described later. The carrier includes a plurality of carrier particles each having features described later.

The two-component developer according to the present embodiment can be used for example in an electrophotographic apparatus (image forming apparatus) for image formation. An example of a method by which an electrophotographic apparatus forms an image will be described below.

First, an image forming section (charger and exposure device) of the electrophotographic apparatus forms an electrostatic latent image on a photosensitive member (for example, a surface layer portion of a photosensitive drum) based on image data. Subsequently, a developing device (specifically, a developing device loaded with a two-component developer) of the electrophotographic apparatus supplies only toner of the two-component developer to the photosensitive member to develop the electrostatic latent image formed on the photosensitive member. The toner before supplied to the photosensitive member is charged by friction with carrier in the developing device. The positively chargeable toner is charged positively. In the developing process, toner (specifically, charged toner) on a developing sleeve (for example, a surface layer portion of a development roller of the developing device) located in the vicinity of the photosensitive member is supplied to the photosensitive member to be attached to the electrostatic latent image on the photosensitive member. As a result, a toner image is formed on the photosensitive member. For consumed toner, the developing device is replenished with toner from a toner container loaded with toner for replenishment.

In a subsequent transfer process, a transfer device of the electrophotographic apparatus transfers the toner image on the photosensitive member to an intermediate transfer member (for example, a transfer belt) and further transfers the toner image from the intermediate transfer member to a recording medium (for example, paper). Thereafter, a fixing device (fixing method: nip fixing using a heating roller and a pressure roller) of the electrophotographic apparatus fixes the toner to the recording medium by applying heat and pressure to the toner. Through the above processes, an image is formed on the recording medium. A full-color image can for example be formed by superposing toner images of four different colors: black, yellow, magenta, and cyan. Note that the transfer process may be a direct transfer process by which the toner image on the photosensitive member is directly transferred to the recording medium not via the intermediate transfer member. Furthermore, the fixing process may be a belt fixing process.

The two-component developer according to the present embodiment has the following features (also referred to below as basic features).

(Basic Features of Two-component Developer)

The two-component developer includes a toner (specifically, positively chargeable toner) and a carrier. The toner includes a plurality of toner particles each including a toner mother particle and a plurality of resin particles (also referred to below as first resin particles) attached to the surface of the toner mother particle. An anionic surfactant having higher negative chargeability than the first resin particles is present on the surfaces of the first resin particles. The carrier includes a plurality of carrier particles each including a carrier mother particle and a plurality of resin particles (also referred to below as second resin particles) attached to the surface of the carrier mother particle. A cationic surfactant having higher positive chargeability than the second resin particles is present on the surfaces of the second resin particles. The first resin particles have a zeta potential lower than 0 mV at a pH of 5. The second resin particles have a zeta potential higher than 0 mV at a pH of 5. Note that a zeta potential measuring method is the same as a method employed in Examples, which will be described later, or any suitable alternative method.

A zeta potential of either resin particles defined in the above basic features will be also referred to below simply as a zeta potential of the resin particles by omitting for example the measurement conditions.

In a typical image forming apparatus, toner remaining on the photosensitive drum is removed together with other extraneous matter on the photosensitive drum by cleaning after the transfer process. In for example a blade cleaning, the extraneous matter on the photosensitive drum is scraped and removed in a manner that an edge of a cleaning blade rubs the surface of the photosensitive drum.

When resin particles (external additive) are attached to the surface of the toner mother particle, high-temperature preservability of the toner can be improved. The resin particles preferably have a number average primary particle diameter of at least 50 nm and no greater than 100 nm in order that the resin particles function as spacers among the toner particles. However, the present inventor has found that use of resin particles as an external additive of toner particles involves the following problems. The present inventor has then invented a two-component developer having the above basic features in order to solve such the problems.

Initial chargeability only of a toner can be adjusted comparatively easily into a desired range by a typical toner designing technique (specific examples include selection of binder resin or external additive and adjustment of amount of external additive). However, it is difficult to inhibit degradation of chargeability of a toner and charge imparting property of a carrier that are accompanied by long-term use of a two-component developer. For example, a two-component developer (toner and carrier) is used while being stirred in a developing device in a typical image forming apparatus. In a configuration for example in which external additive particles to which positive chargeability is imparted by surface treatment are used as an external additive of the toner particles, abrasion of the external additive particles due to stress by stirring causes impairment of effects of providing the surface treatment of the external additive particles (eventually, positive chargeability of toner), with a result that the charge of the toner tend to be insufficient. Further, in a configuration in which positive chargeability is imparted to the toner particles with use of the external additive, stirring causes separation of the external additive from the toner particles, thereby impairing positive chargeability of the tone, with a result that the charge of the toner tends to be insufficient. The external additive separated from the toner particles may adhere to the carrier particles in the developing device. Adhesion of the external additive of the toner particles to the carrier particles may impair charge imparting property (negative chargeability) of the carrier, with a result that the charge of the toner tends to be insufficient. For the reasons as above, either or both of the positive chargeability of the toner and the charge imparting property (negative chargeability) of the carrier tend(s) to be impaired as time passes from a start of use of the two-component developer.

The first resin particles each having a surface on which the anionic surfactant is present are used as an external additive on purpose in the toner particle that is to be positively charged in the two-component developer having the aforementioned basic features. The first resin particles have a zeta potential lower than 0 mV at a pH of 5. Furthermore, the second resin particles each having a surface on which a cationic surfactant is present are used as an external additive on purpose in the carrier particle that is to have sufficient negative chargeability for positively charging the toner particles. The second resin particles have a zeta potential higher than 0 mV at a pH of 5.

The anionic surfactant can be caused to be present on the surface of the first resin particle for example in a manner that: a polymerization reaction (polymerization of the resin particles) for forming the first resin particles is caused in a liquid containing a material of the first resin particles (raw resin material) and the anionic surfactant and the first resin particles are not washed (or the anionic surfactant present on the surfaces of the first resin particles is not thoroughly removed in a washing process) after being taken out from the liquid. The anionic surfactant is attached to the surface of the first resin particle. When the first resin particle is changed to the second resin particle and the anionic surfactant is changed to the cationic surfactant in the above manner, the cationic surfactant can be caused to be present on the surface of the second resin particle.

When the anionic surfactant is removed from the surface of the first resin particle due to stress by stirring in the developing device, the positive chargeability of the toner is thought to increase due to influence of the first resin particle having higher positive chargeability than the anionic surfactant. When the cationic surfactant is removed from the surface of the second resin particle due to stress by stirring in the developing device, charge imparting property (negative chargeability) of the carrier is thought to increase due to influence of the second resin particle having higher negative chargeability than the cationic surfactant. Specifically, the resin particles themselves (resin particles to which no surfactant is attached) tend to have a zeta potential of approximately 0 mV at a pH of 5. For the reason as above, removal of the anionic surfactant from the surface of the first resin particle is thought to impair negative chargeability of the toner (eventually, increase positive chargeability of the toner).

Further, removal of the cationic surfactant from the surface of the second resin particle is thought to impair positive chargeability of the carrier (eventually, increase negative chargeability of the carrier).

The first resin particles (specifically, resin particles having the surfaces on which the anionic surfactant is present) have a zeta potential lower than 0 mV at a pH of 5. Therefore, separation of the first resin particles from the toner particles through stirring in the developing device is thought to increase positive chargeability of the toner. The second resin particles (specifically, resin particles having the surfaces on which the cationic surfactant is present) have a zeta potential higher than 0 mV at a pH of 5. Therefore, separation of the second resin particles from the carrier particles through stirring in the developing device is thought to increase charge imparting property (negative chargeability) of the carrier.

As described above, sufficient positive chargeability of the toner and sufficient charge imparting property (negative chargeability) of the carrier even in continuous printing can be ensured with use of the two-component developer having the aforementioned basic features. Note that the initial chargeability of the toner can be adjusted for example by using an external additive of the toner particle. For example, when inorganic particles having higher positive chargeability than the first resin particle are attached to the surface of the toner mother particle in addition to the first resin particles, the positive chargeability of the toner can be increased.

The second resin particles are present on the surface of the carrier mother particle in the two-component developer having the aforementioned basic features. The second resin particles protrude from the surface of the carrier mother particle. Such the presence of the second resin particles makes first resin particles that are separated from the toner particles hardly adhere to the surfaces of the carrier mother particles. Accordingly, the first resin particle (external additive of toner particle) hardly moves from a toner particle to a carrier particle in the developing device. Even if the external additive would move from a toner particle to a carrier particle, the charge imparting property of the carrier is thought to vary less since the second resin particles are present from the first on the surface of the carrier mother particle. For the reasons as above, charge failure of the toner hardly occurs in the two-component developer having the aforementioned basic features. Use of such the two-component developer can inhibit replenishment fogging (fogging caused due to charge failure of toner in replenishment of a developing device with a large amount of toner at a stroke) in continuous printing.

As described above, sufficient positive chargeability of the toner and sufficient charge imparting property (negative chargeability) of the carrier in continuous printing can be ensured with use of the two-component developer having the aforementioned basic features, with a result that a high-quality image can be formed continuously. Ensuring sufficient positive chargeability of the toner and sufficient charge imparting property (negative chargeability) of the carrier in continuous printing can make replenishment fogging hardly occur.

It is preferable in the two-component developer having the aforementioned basic features that the zeta potential of the first resin particles (zeta potential of the first resin particles at a pH of 5) is at least −30.0 mV and no greater than −3.0 mV and the zeta potential of the second resin particles (zeta potential of the second resin particles at a pH of 5) is at least 3.0 mV and no greater than 30.0 mV in order that a high-quality image is formed continuously in continuous printing, and it is more preferable that the zeta potential of the first resin particles is at least −20.0 mV and no greater than −10.0 mV and the zeta potential of the second resin particles is at least 10.0 mV and no greater than 20.0 mV. It is also preferable that the anionic surfactant on the surface of the first resin particle is an anionic surfactant having a sulfate anion group or a sulfonate anion group and the cationic surfactant on the surface of the second resin particle is a nitrogen-containing cationic surfactant in order that the zeta potentials of the first and second resin particles fall in the respective preferable ranges. It is particularly preferable that: the anionic surfactant on the surface of the first resin particle includes at least one surfactant selected from the group consisting of alkyl sulfate ester salts each having an alkyl group having a carbon number of at least 10 and no greater than 25 and straight-chain alkyl benzene sulfonates each having a straight-chain alkyl group having a carbon number of at least 10 and no greater than 25; and the cationic surfactant on the surface of the second resin particle includes at least one surfactant selected from the group consisting of alkyl trimethyl ammonium salts each having an alkyl group having a carbon number of at least 10 and no greater than 25 and alkylamine acetates each having an alkyl group having a carbon number of at least 10 and no greater than 25.

It is preferable that the amount of the first resin particles is at least 0.50 parts by mass and no greater than 3.0 parts by mass relative to 100 parts by mass of the toner mother particles and the amount of the second resin particles is at least 0.05 parts by mass and no greater than 0.30 parts by mass relative to 100 parts by mass of the carrier mother particles in order that the first and second resin particles preferably function.

The first resin particle (toner external additive: external additive of toner particles) and the second resin particle (carrier external additive: external additive of carrier particles) have the same physical property (or similar physical property) in order to inhibit variation in charge imparting property of the carrier in a situation in which movement of the external additive from the toner particles to the carrier particles occurs. For example, difference in number average primary particle diameter between the first resin particles and the second resin particles is preferably no greater than 10 nm in absolute value. The first and second resin particles are preferably made from the same type of resin.

Preferably, the first and second resin particles each contain for example a cross-linked styrene-acrylic acid based resin. The cross-linked styrene-acrylic acid-based resin is excellent in chargeability, and production of fine particles having uniform shape and dimension is easier with use of the cross-linked styrene-acrylic acid-based resin than with use of a melamine resin. The cross-linked styrene-acrylic acid-based resin has favorable durability and charge stability. As to charge stability, decrease in charge, particularly charge in a high-temperature and high-humidity environment, can be inhibited.

The cross-linked styrene-acrylic acid-based resin is a polymer of at least one styrene-based monomer, at least one acrylic acid-based monomer, and a cross-linking agent. The styrene-based monomers, the acrylic acid-based monomers, and the cross-linking agents listed below for example can be preferably used for synthesis of the cross-linked styrene-acrylic acid-based resin.

Examples of a preferable styrene-based monomer include styrene, alkyl styrenes (specific examples include α-methylstyrene, o-methylstyrene, m-methylstyrene, p-methylstyrene, ethylstyrene, 2,3-dimethylstyrene, 2,4-dimethylstyrene, o-tert-butylstyrene, m-tert-butylstyrene, and p-tert-butylstyrene), and halogenated styrenes (specific examples include α-chlorostyrene, o-chlorostyrene, m-chlorostyrene, and p-chlorostyrene).

Examples of a preferable acrylic acid-based monomer include (meth)acrylic acid, (meth)acrylonitrile, and (meth) acrylic acid alkyl esters. Examples of a preferable (meth) acrylic acid alkyl ester include methyl (meth)acrylate, ethyl (meth)acrylate, n-propyl (meth)acrylate, iso-propyl (meth) acrylate, n-butyl (meth)acrylate, iso-butyl (meth)acrylate, and 2-ethylhexyl (meth)acrylate.

Examples of a preferable cross-linking agent include compounds each having two or more unsaturated bonds. A monocyclic compound having two or more functional groups having a unsaturated bond (specifically, divinylbenzene or the like) or a condensate of two or more monobasic carboxylic acids each having a functional group having an unsaturated bond and one polyhydric alcohol (specific examples include ethylene glycol dimethacrylate and butanediol dimethacrylate) is particularly preferable. Examples of a functional group having a unsaturated bond include a vinyl group ($CH_2$═CH—) and a functional group in which at least one hydrogen atom in a vinyl group is substituted with another atom or atomic group.

In a preferable combination of the first and second resin particles, the first resin particle contains a polymer (also referred to below as a first cross-linked styrene-acrylic acid-based resin) of a (meth)acrylic acid alkyl ester (also referred to below as a first (meth)acrylic acid alkyl ester) having an alkyl group having a carbon number of at least 1 and no greater than 4 at its ester portion, a styrene-based monomer (also referred to below as a first styrene-based monomer), and a cross-linking agent (also referred to below as a first cross-linking agent) having two or more unsaturated bonds, and the second resin particle contains a polymer (also referred to below as a second cross-linked styrene-acrylic acid-based resin) of a (meth)acrylic acid alkyl ester (also referred to below as a second (meth)acrylic acid alkyl ester) having an alkyl group having a carbon number of at least 1 and no greater than 4 at its ester portion, a styrene-based monomer (also referred to below as a second styrene-based monomer), and a cross-linking agent (also referred to below as a second cross-linking agent) having two or more unsaturated bonds.

It is preferable that the cross-linked styrene-acrylic acid-based resin contained in the first resin particle and the cross-linked styrene-acrylic acid-based resin contained in the second resin particle are made from the same monomer and the same cross-linking agent in order to inhibit variation in chargeability of either or both of the toner and the carrier which is accompanied by long-term use of the two-component developer. In the combination of the first and second cross-linked styrene-acrylic acid-based resins, it is preferable that: the first and second (meth)acrylic acid alkyl esters each are butyl methacrylate; the first and second styrene-based monomers each are styrene; and the first and second cross-linking agents each are divinylbenzene or ethylene glycol dimethacrylate.

The carrier mother particle preferably includes a carrier core and a coat layer covering the surface of the carrier core in order to appropriately attach the second resin particles to the surface of the carrier mother particle. It is also preferable that inorganic particles are attached to the surface of the toner mother particle in addition to the first resin particles and no inorganic particles are externally added to the surface of the carrier mother particle in order to obtain a two-component developer suitable for image formation. Attachment of the inorganic particles to the toner mother particle can result in that sufficient fluidity of the toner can be easily ensured. Attachment of titanium oxide particles to the surface of the toner mother particle can enable impartment of polishing characteristics to the toner particle. When no inorganic particles are attached to the surface of the carrier mother particle, variation in charge imparting property of the carrier can be inhibited. A state in which the inorganic particles (external additive of toner particles) separated from the toner particles through mixing of the toner with the carrier in production of the two-component developer are attached to the surface of the carrier mother particle does not equate to a state in which inorganic particles are externally added to the surface of the carrier mother particle. The inorganic particles separated from the toner particles in the two-component developer are thought not to be integral with (bonded to) the carrier mother particle and to be present on the surface of the carrier mother particle in a state of being readily separated from the carrier mother particle. The state in which "inorganic particles externally added to the surface of the carrier mother particle" means a state in which the inorganic particles are integral with (bonded to) the carrier mother particle at least in a stationary state (state in which no stress is applied) so as to be held stably on the surface of the carrier mother particle.

An external additive different from an internal additive is not present within a mother particle and selectively present only on the surface of the mother particle. The external additive can be attached to the surface of the mother particle for example by stirring the mother particles (powder) together with the external additive (powder) in an external addition process. Stirring makes the external additive particles integral with the mother particle with a result that the external additive particles are held stably on the surface of the mother particle. The mother particle does not chemically react with the external additive particles. The mother particle and the external additive particles bond together physically not chemically. Bonding strength between the mother particle and the external additive particles can be adjusted for example by controlling mixing conditions (specific examples include a mixing time period and a rotational speed of stirring) and a particle size, shape, hardness, and surface condition of the external additive particles. Preferably, the external additive particles are bonded firmly to the surface of the mother particle in order to inhibit separation of the external additive particles. The external additive particles may be fixed to the surface of the mother particle by being embedded through mechanical bonding. External additive particles for example having a large particle size can be fixed to the surface of the mother particle in a manner that respective parts (bottom parts) of the external additive particles are embedded in a surface layer portion of each of the mother particles by strongly stirring the mother particles and the external additive together. However, external additive particles having a too large particle size are difficult to be fixed to the surface of the mother particle. Preferably, the external additive particles are weakly bonded to the surface of the mother particle (for example, spherical external additive particles having a small particle size are attached to the surface of mother particle in a rotatable manner) in order to improve fluidity of the toner or the carrier through use of the external additive particles. The external additive particles (for example, silica particles) for improving fluidity of the toner or the carrier are preferably attached to the surface of the mother particle mainly by Van der Waals force or static electric force.

An example of the two-component developer having the aforementioned basic features will be described below with reference to the drawing.

The two-component developer illustrated in FIGURE includes a toner (powder of toner particles 10) and a carrier (powder of carrier particles 20). The toner includes a plurality of toner particles 10 each including a toner mother particle 11, a plurality of first resin particles 13*a*, and a plurality of inorganic particles 13*b* (for example, silica particles). Both the first resin particles 13*a* and the inorganic particles 13*b* are attached to the surface of the toner mother particle 11. The carrier includes a plurality of carrier particles 20 each including a carrier mother particle (a carrier core 21 and a coat layer 22) and a plurality of second resin particles 23. The carrier mother particle includes the carrier core 21 and the coat layer 22 covering the surface of the carrier core 21. The coat layer 22 may cover the entirety of the carrier core 21 or partially cover a surface region of the carrier core 21. However, it is preferable that the coat layer 22 fully cover the entire region of the carrier core 21 (at a covering area ratio of 100%) in order to ensure sufficient charge imparting property and durability of the carrier. The second resin particles 23 are attached to the surface of the carrier mother particle. The first resin particles 13*a* each having a surface on which an anionic surfactant is present have a zeta potential lower than 0 mV at a pH of 5. The second resin particles 23 each having a surface on which a cationic surfactant is present have a zeta potential higher than 0 mV at a pH of 5.

The toner particles included in the toner may each include a toner mother particle including no shell layer (also referred to below as a non-capsule toner particle) or a toner mother particle having a shell layer (also referred to below as a capsule toner particle). Capsule toner particles can be produced by forming shell layers on the respective surfaces of the toner mother particles (toner cores) of non-capsule toner particles. The shell layer may be substantially made from a thermosetting resin only or a thermoplastic resin only or contain both a thermoplastic resin and a thermosetting resin.

The non-capsule toner particles can be produced for example by a pulverization method or an aggregation method. Either methods can favorably and readily disperse an internal additive in a binder resin of the non-capsule toner particle. Note that it is known in the technical field to which the present disclosure belongs that toner is categorized into pulverized toner and polymerized toner (also called chemical toner). Toners produced by the pulverization method belong to the pulverized toner, while toners produced by the aggregation method belong to the polymerized toner.

In an example of the pulverization method, a binder resin, a colorant, a charge control agent, and a releasing agent are first mixed together. Subsequently, the resultant mixture was melt-kneaded using a melt-kneader (for example, a single or twin screw extruder). The resultant melt-knead substance is then pulverized and the resultant pulverized substance is classified. Through the above processes, toner mother particles are obtained. When the pulverization method is employed, the toner mother particles can be produced more easily than when the aggregation method is employed.

In an example of the aggregation method, a binder resin, a releasing agent, a charge control agent, and a colorant each in the form of fine particles are initially caused to aggregate in an aqueous medium to form particles having a desired particle size. Through the above aggregation, aggregated particles containing components of the binder resin, the releasing agent, the charge control agent, and the colorant are formed. Subsequently, the aggregated particles are heated to cause coalescence of the components contained in the aggregated particles. Through the above processes, toner mother particles having a desired particle size are obtained.

Any shell layer formation method can be employed in production of the capsule toner particles. The shell layers may be formed for example by in-situ polymerization, in-liquid curing film coating, or coacervation.

Preferable examples of respective configurations of the non-capsule toner particle and the carrier particle will be described next. Note that a toner mother particle of the non-capsule toner particle described below may be used as a toner core of the capsule toner particle.

[Toner Mother Particle]

The toner mother particle contains a binder resin. The toner mother particle may optionally contain an internal additive (for example, a colorant, a releasing agent, a charge control agent, and a magnetic powder).

(Binder Resin)

Typically, the binder resin is a main component (for example, at least 85% by mass) of the toner mother particle. Properties of the binder resin are therefore thought to have great influence on properties of the toner mother particle as a whole.

Examples of a preferable binder resin include styrene-based resin, acrylic acid-based resins (specific examples include an acrylic acid ester polymer and a methacrylic acid ester polymer), olefin-based resins (specific examples include a polyethylene resin and a polypropylene resin), vinyl chloride resin, polyvinyl alcohol, vinyl ether resin, N-vinyl resin, polyester resin, polyamide resin, and urethane resin. A copolymer of any of the resins listed above, that is, a copolymer including any repeating unit introduced into any of the resins listed above (specific examples include a styrene-acrylic acid-based resin and a styrene-butadiene-based resin) may be used.

The toner mother particle preferably contains either a polyester resin or a styrene-acrylic acid-based resin in order to improve both high-temperature preservability and low-temperature fixability of the toner, and particularly preferably contains the polyester resin.

The polyester resin can be obtained by condensation polymerization of at least one polyhydric alcohol (specific examples include aliphatic diols, bisphenols, and tri- or higher hydric alcohols listed below) and at least one polybasic carboxylic acid (specific examples include dibasic carboxylic acids and tri- or higher-basic carboxylic acids listed below). The polyester resin may include a repeating unit derived from another monomer (monomer that is neither the polyhydric alcohol nor the polybasic carboxylic acid).

Examples of a preferable aliphatic diol include diethylene glycol, triethylene glycol, neopentyl glycol, 1,2-propanediol, α,ω-alkanediols (specific examples include ethylene glycol, 1,3-propanediol, 1,4-butanediol, 1,5-pentanediol, 1,6-hexanediol, 1,7-heptanediol, 1,8-octanediol, 1,9-nonanediol, and 1,12-dodecanediol), 2-buthen-1,4-diol, 1,4-cyclohexanedimethanol, dipropylene glycol, polyethylene glycol, polypropylene glycol, and polytetramethylene glycol.

Examples of a preferable bisphenol include bisphenol A, hydrogenated bisphenol A, bisphenol A ethylene oxide adduct, and bisphenol A propylene oxide adduct.

Examples of a preferable tri- or higher hydric alcohol include sorbitol, 1,2,3,6-hexanetetraol. 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of a preferable dibasic carboxylic acid include aromatic dicarboxylic acids (specific examples include phthalic acid, terephthalic acid, and isophthalic acid), α,ω-alkane dicarboxylic acids (specific examples include malonic acid, succinic acid, adipic acid, suberic acid, azelaic acid, sebasic acid, and 1,10-decanedicarboxylic acid), alkyl succinic acids (specific examples include n-butylsuccinic acid, isobutylsuccinic acid, n-octylsuccinic acid, n-dodecylsuccinic acid, and isododecylsuccinic acid), alkenylsuccinic acids (specific examples include n-butenylsuccinic acid, isobutenylsuccinic acid, n-octenylsuccinic acid, n-dodecenylsuccinic acid, and isododecenylsuccinic acid), maleic acid, fumaric acid, citraconic acid, itaconic acid, glutaconic acid, and cyclohexanedicarboxylic acid.

Examples of a preferable tri- or higher basic carboxylic acid include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and Empol trimer acid.

(Colorant)

The toner mother particle may optionally contain a colorant. The colorant can be for example a known pigment or dye that matches the color of the toner. The amount of the colorant is preferably at least 1 part by mass and no greater than 20 parts by mass relative to 100 parts by mass of the binder resin in order to obtain a toner suitable for image formation.

The toner mother particle may optionally contain a black colorant. The black colorant may for example be carbon black. Alternatively, the black colorant may be a colorant that is adjusted to a black color using a yellow colorant, a magenta colorant, and a cyan colorant.

The toner mother particle may optionally contain a non-black colorant such as a yellow colorant, a magenta colorant, or a cyan colorant.

One or more compounds for example selected from the group consisting of condensed azo compounds, isoindolinone compounds, anthraquinone compounds, azo metal complexes, methine compounds, and arylamide compounds can be used as the yellow colorant. Examples of a yellow colorant that can be preferably used include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow G, and C.I. Vat Yellow.

One or more compounds for example selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds can be used as the magenta colorant. Examples of a magenta colorant that can be preferably used include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

One or more compounds for example selected from the group consisting of copper phthalocyanine compounds, anthraquinone compounds, and basic dye lake compounds can be used as the cyan colorant. Examples of a cyan colorant that can be preferably used include C.I. Pigment Blue (1, 7, 15, 15:1, 15:2, 15:3, 15:4, 60, 62, and 66), Phthalocyanine Blue, C.I. Vat Blue, and C.I. Acid Blue.

(Releasing Agent)

The toner mother particle may optionally contain a releasing agent. The releasing agent is used for example for the purpose of improving fixability of the toner or resistance of the toner to being offset. The amount of the releasing agent is preferably at least 1 part by mass and no greater than 30 parts by mass relative to 100 parts by mass of the binder resin in order to improve fixability or offset resistance of the toner.

Examples of a releasing agent that can be preferably used include: aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide wax and block copolymer of polyethylene oxide wax; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; waxes having a fatty acid ester as a main component such as montanic acid ester wax and castor wax; and waxes in which a fatty acid ester has been partially or fully deoxidized such as deoxidized carnauba wax. One releasing agent listed above may be used alone, or two or more releasing agents listed above may be used in combination.

(Charge Control Agent)

The toner mother particle may optionally contain a charge control agent. The charge control agent is used for the purpose of improving charge stability or a charge rise characteristic of the toner. The charge rise characteristic of the toner is an indicator as to whether the toner can be charged to a specific charge level in a short period of time.

Cationic strength of the toner mother particle can be increased by including a positively chargeable charge control agent (specific examples include pyridine, nigrosine, and quaternary ammonium salt) in the toner mother particle. However, in a configuration in which sufficient chargeability of the toner can be ensured, the toner mother particle need not contain a charge control agent.

(Magnetic Powder)

The toner mother particle may optionally contain a magnetic powder. Examples of a material of the magnetic powder that can be preferably used include ferromagnetic metals (specific examples include iron, cobalt, nickel, and an alloy containing at least one of these), oxides of ferromagnetic metals (specific examples include ferrite, magnetite, and chromium dioxide), and materials subjected to ferromagnetization (for example, a carbon material to which ferromagnetism is imparted by thermal treatment). Magnetic particles subjected to surface treatment are preferably used as the magnetic powder in order to inhibit elution of metal ions (for example, iron ions) from the magnetic powder. One magnetic powder listed above may be used alone, or two or more magnetic powders listed above may be used in combination.

[Toner External Additive]

Toner external additive (specifically, a powder including a plurality of external additive particles) is attached to the surface of the toner mother particle in the two-component developer having the aforementioned basic features. The toner particle includes a plurality of first resin particles as the toner external additive. For example, when the toner mother particles (powder) and the external additive (powder) are stirred together, respective parts (bottom parts) of the external additive particles (for example, first resin particles) are embedded in a surface layer portion of the toner mother particle with a result that the external additive particles are attached (physically bonded) to the surface of the toner mother particle by physical power.

Preferably, the first resin particle (toner external additive) is a resin particle containing at least one resin selected from the group consisting of cross-linked styrene-based resins, cross-linked acrylic acid-based resins, cross-linked styrene-acrylic acid-based resins, cross-linked polyester resins, cross-linked urethane resins, cross-linked polyacrylamide resins, and cross-linked polyacrylonitrile resins with a resin particle containing a cross-linked styrene-acrylic acid-based resin being particularly preferable.

An anionic surfactant having higher negative chargeability than the first resin particle is present on the surface of the first resin particle. Examples of a preferable anionic surfactant include sulfuric ester surfactants (specific example is alkyl sulfate ester salt), sulfonic acid surfactants (specific examples include alkyl sulfonate, straight-chain alkyl benzene sulfonate, perfluoroalkyl sulfonate, and naphthalene sulfonate), carboxylic acid surfactants (specific examples include fatty acid salt having an alkyl group having a carbon number of at least 6 and no greater than 25 and perfluoro fatty acid salt), and phosphate ester surfactants (specific examples include phosphate ester and alkyl phosphate ester salt). Examples of a preferable anionic surfactant include anionic surfactants each having a sulfate anion group (—$OSO_3$—) or a sulfonate anion group (—$SO_3$—) (specific examples include a sulfuric ester surfactant and a sulfonic acid surfactant). A straight-chain alkyl benzene sulfonate having a straight-chain alkyl group having a carbon number of at least 10 and no greater than 25 (for example, sodium dodecylbenzenesulfonate having straight-chain alkyl group having a carbon number of 12) or an alkyl sulfate ester salt having an alkyl group having a carbon number of at least 10 or no greater than 25 (for example, sodium lauryl sulfate having an alkyl group having a carbon number of 12) is particularly preferable.

Inorganic particles may be attached to the surface of the toner mother particle in addition to the first resin particles. At least one type of particles selected from the group consisting of silica particles and particles of metal oxides (specific examples include alumina, titanium oxide, magnesium oxide, zinc oxide, strontium titanate, and barium titanate) is preferable as the inorganic particles (toner external additive), and at least one type of particles selected from the group consisting of silica particles and titanium oxide particles is particularly preferable.

The external additive particles may be subjected to surface treatment. In a situation for example in which silica particles are used as the external additive particles, either or both of hydrophobicity and positive chargeability may be imparted to the surfaces of the silica particles by surface preparation agent. Examples of a surface preparation agent that can be preferably used include coupling agents (specific examples include a silane coupling agent, a titanate coupling agent, and an aluminate coupling agent), silazane compounds (specific examples include a straight-chain silazane compound and a cyclic silazane compound), and silicone oils (specific examples include dimethylsilicone oil). A silane coupling agent or a silazane compound is particularly preferable as the surface preparation agent. Examples of a preferable silane coupling agent include silane compounds (specific examples include methyltrimethoxysilane and aminosilane). An example of a preferable silazane compound is hexamethyldisilazane (HMDS).

When the surface of a silica base (non-treated silica particles) is treated with a surface preparation agent, multiple hydroxyl groups (—OH) present on the surface of the silica base is partially or completely substituted with a functional group originated from the surface preparation agent. As a result, silica particles each having a surface on which the functional group originated from the surface preparation agent (specifically, a functional group having higher hydrophobicity and/or positive chargeability than the hydroxyl group) is present can be obtained. When the surface of the silica base is treated for example with a silane coupling agent having an amino group, a dehydration condensation reaction of a hydroxyl group of the silane coupling agent (for example, a hydroxyl group generated through hydrolysis of an alkoxy group of the silane coupling agent by moisture) with a hydroxyl group present on the surface of the silica base ("A (silica base)-OH"+"B (coupling agent)-OH"→"A-O—B"+$H_2O$) is caused. When the silane coupling agent having the amino group is chemically bonded to silica through the above reaction, the amino group is provided on the surfaces of the silica particles. More specifically, the hydroxyl group present on the surface of the silica base is substituted with a functional group having a terminal amino group (more specifically, —O—Si—$(CH_2)_3$—$NH_2$ or the like). The silica particles having the amino group tend to have higher positive chargeability than the silica base (non-treated silica particles). In a situation in which a silane coupling agent having an alkyl group is used, the hydroxyl group present on the surface of the silica base can be substituted with a functional group having a terminal alkyl group (specifically, —O—Si—$CH_3$ or the like) through the above dehydration condensation reaction. As such, the silica particles having a hydrophobic group (alkyl group) rather than a hydrophilic group (hydroxyl group) tend to have higher hydrophobicity than the silica base (non-treated silica particles).

[Carrier Mother Particle]

The carrier mother particle may be a carrier mother particle including no coat layer (for example, ferrite carrier particle) or a carrier mother particle including a coat layer (also referred to below as a coated carrier particle). Use of the coated carrier particle is preferable in order that a high-quality image is formed with the two-component developer for an extended period of term. The coated carrier particle includes a carrier core and a coat layer covering the surface of the carrier core. The coat layer covers preferably at least 90% and particularly preferably 100% of a surface region of the carrier core in order to ensure sufficient charge imparting property and durability of the carrier.

The following describes a preferable example of the coated carrier particle. Note that the carrier core having the following configuration may be directly used as a carrier mother particle not covered with the coat layer.

(Carrier Core)

The carrier core preferably contains a magnetic material. The carrier core may be a particle of a magnetic material or a carrier core containing a binder resin in which particles of a magnetic material is dispersed. Examples of a preferable magnetic material contained in the carrier core include iron oxides such as magnetite, barium ferrite, maghemite, Mn—Zn ferrite, Ni—Zn ferrite, Mn—Mg ferrite, Ca—Mg ferrite, Li ferrite, and Cu—Zn ferrite. One of the magnetic materials listed above may be used alone or two or more of the magnetic materials listed above may be used in combination as a material of the carrier core. Commercially-available carrier cores may be used. Alternatively, self-made carrier cores may be produced by pulverizing and baking a magnetic material. When the additive amount of the magnetic material (particularly, ratio of ferromagnetic material) is changed in carrier core production, saturation magnetization of the carrier can be adjusted. When baking temperature is changed in carrier core production, roundness of the carriers can be also adjusted.

(Coat Layer)

The coat layer is disposed on the surface of the carrier core to cover the carrier core. The coat layer is made substantially from a resin. An additive may be dispersed in the resin forming the coat layer. Examples of a coat layer formation method include a method in which carrier cores are immersed in a liquid containing the resin (or a material of the resin) and a method in which a liquid containing the resin (or a material of the resin) is sprayed toward carrier cores in a fluidized bed.

At least one resin selected from the group consisting of fluororesins, silicone resins, polyamide-imide resins, and polyimide resins is preferable as the resin forming the coat layer. The coat layer preferably contains a fluororesin and at least one resin selected from the group consisting of polyamide-imide resins (PAIs) and polyimide resins (PIs) in order to reduce adhesiveness (adhesion readiness) to the carrier mother particle. At least one resin selected from the group consisting of polyvinyl fluoride, polyvinylidene fluoride, polytetrafluoroethylene (PTFE), polytrifluoroethylenes (a specific example is polychlorotrifluoroethylene), polyhexafluoropropylene, tetrafluoroethylene-hexafluoropropylene copolymer (FEP), and tetrafluoroethylene-perfluoroalkylvinylether copolymer (PFA) is preferable as a fluororesin contained in the coat layer with FEP or PFA being particularly preferable.

[Carrier External Additive]

An external additive (specifically, a powder including a plurality of external additive particles) is attached to the surface of the carrier mother particle in the two-component developer having the aforementioned basic features. The carrier particle includes a plurality of second resin particles as the carrier external additive. For example, when the carrier mother particles (powder) and the external additive (powder) are stirred together, respective parts (bottom parts) of the external additive particles (for example, second resin particles) are embedded in a surface layer portion of the carrier mother particle with a result that the external additive particles are attached (physically bonded) to the surface of the carrier mother particle by physical power.

The second resin particles (carrier external additive) each are preferably a resin particle containing at least one resin selected from the group consisting of cross-linked styrene-based resins, cross-linked acrylic acid-based resins, cross-linked styrene-acrylic acid-based resins, cross-linked polyester resins, cross-linked urethane resins, cross-linked polyacrylamide resins, and cross-linked polyacrylonitrile resins with a resin particle containing a cross-linked styrene-acrylic acid-based resin being particularly preferable.

A cationic surfactant having higher positive chargeability than the second resin particles is present on the surfaces of the second resin particles. A nitrogen-containing cationic surfactant is preferable as the cationic surfactant. Examples of a preferable nitrogen-containing cationic surfactant include quaternary ammonium salt surfactants (specific examples include alkyl trimethyl ammonium salt, dialkyldimethylammonium salt, alkyl benzyl dimethyl ammonium salt, and benzethonium chloride), alkyl amine salt surfactants (specific examples include alkylamine acetate, and alkylamine hydrochloride), and surfactants having a pyridine ring (specific examples include butylpyridinium chloride and cetylpyridinium chloride). An alkyl trimethyl ammonium salt having a carbon number of at least 10 and no greater than 25 (for example, cetyltrimethylammonium chloride having an alkyl group having a carbon number of 16) or an alkylamine acetate having an alkyl group having a carbon number of at least 10 and no greater than 25 (for example, stearylamine acetate having an alkyl group having a carbon number of 18) is particularly preferable as the cationic surfactant.

EXAMPLES

The following describes examples of the present disclosure. Table 1 indicates developers DA-1-DA-6 and DB-1-DB-4 of Examples or Comparative Examples (each are a two-component developer for electrostatic latent image development). Furthermore, Table 2 indicates external additives (resin particles S-1-S-6) used in production of the developers listed in Table 1.

TABLE 1

| | External additive (Resin particles) | | | |
|---|---|---|---|---|
| | Toner | | Carrier | |
| Developer | First resin particles | Zeta potential [mV] | Second resin particles | Zeta potential [mV] |
| DA-1 | S-3 | −18.4 | S-1 | +15.5 |
| DA-2 | S-3 | −18.4 | S-5 | +11.2 |
| DA-3 | S-3 | −18.4 | S-2 | +4.6 |
| DA-4 | S-6 | −14.1 | S-1 | +15.5 |
| DA-5 | S-4 | −5.8 | S-1 | +15.5 |
| DA-6 | S-4 | −5.8 | S-2 | +4.6 |
| DB-1 | S-3 | −18.4 | S-4 | −5.8 |
| DB-2 | S-2 | +4.6 | S-1 | +15.5 |
| DB-3 | S-2 | +4.6 | S-4 | −5.8 |
| DB-4 | None | — | None | — |

TABLE 2

| | Monomer | | Cross-linking agent | Surfactant | | | |
|---|---|---|---|---|---|---|---|
| Resin particles | BMA [g] | S [g] | DVB [g] | CTAC [g] | SLS [g] | SAA [g] | DBS [g] |
| S-1 | 80 | 80 | 40 | 12 | 0 | 0 | 0 |
| S-2 | 80 | 80 | 40 | 3 | 0 | 0 | 0 |
| S-3 | 80 | 80 | 40 | 0 | 12 | 0 | 0 |
| S-4 | 80 | 80 | 40 | 0 | 3 | 0 | 0 |
| S-5 | 80 | 80 | 40 | 0 | 0 | 12 | 0 |
| S-6 | 80 | 80 | 40 | 0 | 0 | 0 | 12 |

Respective items indicating raw resin materials in Table 2 refer to the following.

(Monomer)

BMA: n-butyl methacrylate.

S: styrene.

(Cross-Linking Agent)

DVB: divinylbenzene.

(Surfactant)

CTAC: cetyltrimethylammonium chloride.

SLS: sodium lauryl sulfate.

SAA: stearylamine acetate.

DBS: sodium dodecylbenzenesulfonate.

The following describes production methods, an evaluation method, and evaluation results of the developers DA-1-DA-6 and DB-1-B-4 in stated order. In evaluations in which errors may occur, an evaluation value was calculated by calculating the arithmetic mean of an appropriate number of measured values in order to ensure that any error was sufficiently small.

[Preparation of Materials]

(Preparation of Resin Particles S-1-S-6)

A four-necked flask 1-L equipped with a stirrer, a cooling tube, a thermometer, and a nitrogen inlet tube was charged with 600 g of ion-exchanged water, 15 g of an initiator (BPO: benzoyl peroxide), and an amount of a corresponding one of materials listed in Table 2. In preparation of for example resin particles S-1, 80 g of n-butyl methacrylate (BMA), 80 g of styrene (S), 40 g of a cross-linking agent (DVB: divinylbenzene), and 12 g of a cationic surfactant (CTAC: cetyltrimethylammonium chloride) were charged. Furthermore, in preparation of resin particles S-4, 80 g of n-butyl methacrylate (BMA), 80 g of styrene (S), 40 g of the cross-linking agent (DVB: divinylbenzene), and 3 g of an anionic surfactant (SLS: sodium lauryl sulfate) were charged. Note that divinylbenzene (DVB) used as the cross-linking agent in preparation of the respective resin particles S-1-S6 had a purity of 80% by mass.

Subsequently, the internal atmosphere of the flask was changed to a nitrogen atmosphere by introducing nitrogen gas into the flask while the flask contents were stirred. The temperature of the flask contents was increased to 90° C. while the flask contents were still stirred in the nitrogen atmosphere. A reaction (specifically, polymerization reaction) of the flask contents was then caused for three hours at a temperature of 90° C. in the nitrogen atmosphere, thereby obtaining an emulsion containing a reaction product. The resultant emulsion was then cooled and dehydrated to obtain any of resin particles S-1-S-6 (each are a powder). The resin particles S-1-S-6 were each made substantially from a cross-linked styrene-acrylic acid-based resin. The obtained resin particles S-1-S-6 were directly used in external addition process without being washed.

[Toner Production]

(Preparation of Toner Mother Particles)

Materials prepared as toner mother particles were non-capsule toner particles (binder resin: polyester resin, releasing agent: ester wax ("NISSAN ELECTOR (registered Japanese trademark) WEP-3" produced by NOF Corporation), colorant: carbon black ("MA100" produced by Mitsubishi Chemical Corporation), charge control agent: quaternary ammonium salt ("BONTRON (registered Japanese trademark) P-51" produced by ORIENT CHEMICAL INDUSTRIES, Co., Ltd.), volume median diameter ($D_{50}$): 7.0 μm).

(External Addition of Toner)

A multipurpose compact pulverizing mixer ("Multipurpose Mixer" produced by Nippon Coke & Engineering Co., Ltd., vane rotational speed (maximum): 10,000 rpm) was used to mix for ten minutes 100 parts by mass of the toner mother particles prepared as above, 2 parts by mass of a positively chargeable silica particles (surface treatment: methyl hydrogen polysiloxane ("KF-99P" produced by Shin-Etsu Chemical Co., Ltd.) and 3-aminopropyltriethoxysilane ("KBE-903" produced by Shin-Etsu Chemical Co., Ltd.), number average primary particle diameter: 16 nm, BET specific surface area: approximately 130 $m^2/g$), and 1 part by mass of one of external additives listed in "First resin particle" in Table 1 (one of the resin particles S-2-S-4 and S-6 determined for the respective developers). As a result, toners to be used for production of the respective developers DA-1-DA-6 and DB-1-DB-4 were obtained. The resin particles S-3 were used as an external additive in addition to the silica particles for example in production of a toner of the developer DA-1. Also, resin particles S-6 were used as an external additive in addition to the silica particles for example in production of a toner of the developer DA-4. Only the silica particles were used as an external additive in production of a toner of the developer DB-4.

Table 1 indicates measurement results of the respective zeta potentials (zeta potentials of the first resin particles at a pH of 5) of the first resin particles (toner external additives) of the toners obtained as above. For example, the first resin particles (resin particles S-3) of the toner of the developer DA-1 had a zeta potential of −18.4 mV. The zeta potential was measured according to the following method. Note that the toner of the developer DB-4, which included no resin particles as an external additive, was removed from measurement targets.

<Toner: Zeta Potential Measuring Method>

A surfactant solution was prepared by diluting an aqueous solution of a nonionic surfactant ("EMULGEN (registered Japanese trademark) 120" produced by Kao Corporation, component: polyoxyethylene lauryl ether) at a concentration of 2% by mass with water ten times, and 10 g of a measurement target (toner) was dispersed in 500 mL of the resultant surfactant solution to obtain a toner dispersion.

Subsequently, the resultant toner dispersion was subjected to a ultrasonic treatment for five minutes using a ultrasonic disperser ("Ultrasonic Mini Welder P128" produced by Ultrasonic Engineering Co., Ltd., output power: 100 W, oscillation frequency: 28 kHz) to separate the external additive (silica particles and resin particles) from the toner mother particles. The resin particles (external additive) used were a corresponding one of the aforementioned resin particles S-2-S-4 and S-6.

Next, suction filtration using qualitative filter paper ("Whatman (registered Japanese trademark) grade 3" produced by Whatman plc, pore size: 6 μm) was carried out on the toner dispersion subjected to the ultrasonic treatment. Reslurry by adding ion-exchanged water was then carried out, and suction filtration using the qualitative filter paper was carried out again to obtain a filtrate (specifically, white suspension) containing the external additive (i.e., silica particles and resin particles) separated from the toner particles. The resultant filtrate was then subjected to a centrifugation treatment for one minute using a centrifugal at a rotational speed of 3,000 rpm to precipitate the silica particles heavier (having higher density) than the resin particles. A supernatant containing the resin particles (external additive) was then collected and subjected to pressure filtration to collect a wet cake of the resin particles. The collected wet cake of the resin particles was vacuum dried then. The separation as above was repeated until the total amount of collected resin particles (specifically, dried resin particles) separated from the toner particles was 10 mg, thereby obtaining 10 mg of first resin particles separated from toner particles (also referred to below as toner separate particles). Collection of toner separate particles as above was repeated three times.

Subsequently, 0.03 g of the toner separate particles (powder of resin particles) and 2 g of an aqueous solution of a nonionic surfactant ("EMULGEN 120" produced by Kao Corporation, component: polyoxyethylene lauryl ether) at a concentration of 10% by mass were added to 98 g of ion-exchanged water to disperse the toner separate particles (powder of resin particles) in the liquid. The pH of the resultant dispersion was then adjusted to 5 to obtain a pH-adjusted dispersion. The zeta potential of the toner separate particles contained in the pH-adjusted dispersion as a measurement target was measured by electrophoresis (specifically, electrophoresis by laser Doppler method). Specifically, the zeta potential of the toner separate particles (plurality of resin particles) in the dispersion at a temperature of 23° C. and at a pH of 5 was measured using a zeta potential analyzer utilizing laser Doppler method ("ELSZ-1000" produced by Otsuka Electronics Co., Ltd.).

[Production of Carrier]

(Preparation of Carrier Mother Particles)

The carrier mother particles prepared were coated carrier particles (carrier cores: Mn—Mg—Sr ferrite cores ("EF-50" produced by Powdertech Co., Ltd.), coat layer material: silicone polymer (product of Dow Corning Toray Co., Ltd.), volume median diameter ($D_{50}$): 50 μm). Note that "External Addition of Carrier" below was not carried out in production of a carrier of the developer DB-4 and the prepared carrier mother particles (powder) were directly used as the carrier of the developer DB-4.

(External Additive of Carrier)

A multipurpose compact pulverizing mixer ("Multipurpose Mixer" produced by Nippon Coke & Engineering Co., Ltd., vane rotational speed (maximum): 10,000 rpm) was used to mix 100 parts by mass of the carrier mother particles prepared as above and 0.1 parts by mass of a corresponding one of external additive listed in "Second resin particles" in Table 1 (corresponding one of the resin particles S-1, S-2, S-4, and S-5 determined for the respective developers) for five minutes. As a result, carriers used for production of the respective developers DA-1-DA-6 and DB-1-DB-3 were obtained. For example, the resin particles S-1 were used as an external additive in production of the carrier of the developer DA-1. For example, the resin particles S-5 were used as an external additive in production of the carrier of the developer DA-2.

Table 1 indicates measurement results of the respective zeta potentials (zeta potentials of the second resin particles at a pH of 5) of the second resin particles (carrier external additives) of the respective carriers obtained as above. For example, the second resin particles (resin particles S-1) of the carrier of the developer DA-1 had a zeta potential of 15.5 mV. The zeta potential was measured according to the following method. Note that the carrier of the developer DB-4, which contained no external additive, was removed from measurement targets.

<Carrier: Zeta Potential Measuring Method>

A surfactant solution was prepared by diluting an aqueous solution of a nonionic surfactant ("EMULGEN (registered Japanese trademark) 120" produced by Kao Corporation, component: polyoxyethylene lauryl ether) at a concentration of 2% by mass with water ten times, and 10 g of a measurement target (carrier) was dispersed in 500 mL of the resultant surfactant solution to obtain a carrier dispersion.

Subsequently, the resultant carrier dispersion was subjected to a ultrasonic treatment for five minutes using a ultrasonic disperser ("Ultrasonic Mini Welder P128" produced by Ultrasonic Engineering Co., Ltd., output power: 100 W, oscillation frequency: 28 kHz) to separate the external additive (resin particles) from the carrier mother particles. The resin particles (external additive) used were a corresponding one of the aforementioned resin particles S-1, S-2, S-4, and S-5.

Subsequently, suction filtration using qualitative filter paper ("Whatman (registered Japanese trademark) grade 3" produced by Whatman plc, pore size: 6 μm) was carried out on the carrier dispersion subjected to the ultrasonic treatment. Reslurry by adding ion-exchanged water was then carried out, and suction filtration using the qualitative filter paper was carried out again to collect a wet cake of the resin particles. The collected wet cake of the resin particle was vacuumed dried then. The separation as above was repeated until the total amount of collected resin particles (specifically, dried resin particles) separated from the carrier particles was 10 mg, thereby obtaining 10 mg of second resin particles separated from carrier particles (also referred to below as carrier separate particles). The collection of the carrier separate particles as above was repeated three times.

Subsequently, 0.03 g of the carrier separate particles (powder of resin particles) and 2 g of an aqueous solution of a nonionic surfactant ("EMULGEN 120" produced by Kao Corporation, component: polyoxyethylene lauryl ether) at a concentration of 10% by mass was added to 98 g of ion-exchanged water to disperse the carrier separate particles (powder of resin particles) in the liquid. Next, the pH of the resultant dispersion was adjusted to 5 to obtain a pH-adjusted dispersion. The zeta potential of the carrier separate particles contained in the pH-adjusted dispersion as a measurement target was measured by electrophoresis (specifically, electrophoresis by laser Doppler method). Specifically, the zeta potential of the carrier separate particles (resin particles) in the dispersion at a temperature of 23° C. and at a pH of 5 was measured using a zeta potential analyzer utilizing laser Doppler method ("ELSZ-1000" produced by Otsuka Electronics Co., Ltd.).

(Preparation of Two-component Developer)

A ball mill was used to mix 10 parts by mass of a toner produced through the above processes (each toner determined for corresponding one of the developers listed in Table 1) and 100 parts by mass of a carrier produced through the above processes (each carrier determined for corresponding one of the developers listed in Table 1) for 30 minutes, thereby obtaining developers DA-1-DA-6 and DB-1-DB-4 (each were a two-component developer). The toners contained in the developers DA-1-DA-6 and DB-1-DB-4 each are a positively chargeable toner.

[Evaluation Method]

Each sample (developers DA-1-DA-6 and DB-1-DB-4) was evaluated as follows.

(Resistance to Replenishment Fogging)

An evaluation apparatus used was a multifunction peripheral ("TASKalfa5550ci" produced by KYOCERA Document Solutions Inc.). A sample (evaluation target: one of developers DA-1-DA-6 and DB-1-DB-4) was loaded into a developing device of the evaluation apparatus and a toner (toner for replenishment) corresponding to the sample (developer) was loaded into a toner container of the evaluation apparatus.

A first printing durability test was carried out that was continuous printing on 100,000 pieces of paper (A4-size plain paper) using the evaluation apparatus at a printing rate of 5% in an environment of a temperature of 24° C. and a humidity of 60% RH. After the first printing durability test, white printing was continuously carried out on 1,000 pieces of paper (A4-size plain paper) in an environment at a temperature of 24° C. and a humidity of 60% RH. Subsequently, a second printing durability test was carried out that was continuous printing on ten pieces of paper (A4-size plain paper) at a printing rate of 20%. The fogging density (FD) of paper subjected to the last (tenth) printing in the second printing durability test was measured then. The fogging density (FD) was measured using an automated whiteness meter ("TC-6MC" produced by Tokyo Denshoku Co., Ltd.). A fogging density (FD) of no greater than 0.015 was evaluated as good (Good), and a fogging density (FD) of greater than 0.015 was evaluated as poor (Poor). The fogging density (FD) corresponds to a value obtained by subtracting the reflection density of base paper (non-printed paper) from the reflection density of a blank portion of the printed evaluation paper.

[Evaluation Results]

Table 3 indicates evaluation results of resistance to replenishment fogging (fogging density) for the developers DA-1-DA-6 and DB1-DB-4.

TABLE 3

| | Developer | Resistance to replenishment fogging |
|---|---|---|
| Example 1 | DA-1 | 0.002 |
| Example 2 | DA-2 | 0.006 |
| Example 3 | DA-3 | 0.009 |
| Example 4 | DA-4 | 0.004 |
| Example 5 | DA-5 | 0.009 |
| Example 6 | DA-6 | 0.012 |
| Comparative Example 1 | DB-1 | 0.020 (Poor) |
| Comparative Example 2 | DB-2 | 0.024 (Poor) |
| Comparative Example 3 | DB-3 | 0.032 (Poor) |
| Comparative Example 4 | DB-4 | 0.046 (Poor) |

The developers DA-1-DA-6 (two-component developers of Examples 1-6) each had the aforementioned basic features. Specifically, the developers DA-1-DA-6 each included a toner (positively chargeable toner) and a carrier. The toner included a plurality of toner particles each including a toner mother particle and a plurality of first resin particles attached to the surface of the toner mother particle. An anionic surfactant (SLS or DBS) having higher negative chargeability than the first resin particles was present on the surfaces of the first resin particles (see Tables 1 and 2). The carrier included carrier particles each including a carrier mother particle and the second resin particles attached to the surface of the carrier mother particle. A cationic surfactant (CTAC or SAA) having higher positive chargeability than the second resin particles was present on the surfaces of the second resin particles (see Tables 1 and 2). The first resin particles had a zeta potential lower than 0 mV at a pH of 5 (see Table 1). The second resin particles had a zeta potential higher than 0 mV at a pH of 5 (see Table 1).

Observation of the respective surfaces of the toner particles and the carrier particles using a scanning electron microscope (SEM) found that both the first resin particles (toner external additive) and the second resin particles (carrier external additive) in each of the developers DA-1-DA-6 had a number average primary particle diameter of at least 60 nm and no greater than 90 nm.

As indicated in Table 3, when any of the developers DA-1-DA-6 was used in the continuous printing, sufficient chargeability of the toner and sufficient charge imparting property of the carrier could be ensured while replenishment fogging was inhibited with a result that a high-quality image could be continuously formed.

What is claimed is:

1. A two-component developer comprising a toner and a carrier, wherein the toner is a positively chargeable toner that is positively charged by friction with the carrier, the toner includes a plurality of toner particles each including a toner mother particle and a plurality of first resin particles attached to a surface of the toner mother particle, an anionic surfactant having higher negative chargeability than the first resin particles is present on surfaces of the first resin particles, the carrier includes a plurality of carrier particles each including a carrier mother particle and a plurality of second resin particles attached to a surface of the carrier mother particle, a cationic surfactant having higher positive chargeability than the second resin particles is present on surfaces of the second resin particles, the first resin particles has a zeta potential lower than 0 mV at a pH of 5, and the second resin particles has a zeta potential higher than 0 mV at a pH of 5.

2. The two-component developer according to claim 1, wherein the first resin particles has a zeta potential of at least −30.0 mV and no greater than −3.0 mV at a pH of 5, and the second resin particles has a zeta potential of at least 3.0 mV and no greater than 30.0 mV at a pH of 5.

3. The two-component developer according to claim 2, wherein the anionic surfactant is an anionic surfactant having a sulfate anion group or a sulfonate anion group, and the cationic surfactant is a nitrogen-containing cationic surfactant.

4. The two-component developer according to claim 3, wherein the anionic surfactant includes at least one surfactant selected from the group consisting of alkyl sulfate ester salts each having an alkyl group having a carbon number of at least 10 and no greater than 25 and straight-chain alkyl benzene sulfonates each having a straight-chain alkyl group having a carbon number of at least 10 and no greater than 25, and the cationic surfactant includes at least one surfactant selected from the group consisting of alkyl trimethyl ammonium salts each having an alkyl group having a carbon number of at least 10 and no greater than 25 and alkylamine acetates each having an alkyl group having a carbon number of at least 10 and no greater than 25.

5. The two-component developer according to claim 4, wherein the anionic surfactant is sodium lauryl sulfate or sodium dodecylbenzenesulfonate, and the cationic surfactant is cetyltrimethylammonium chloride or stearylamine acetate.

6. The two-component developer according to claim 1, wherein both the first resin particles and the second resin particles contain a cross-linked styrene-acrylic acid-based resin.

7. The two-component developer according to claim 6, wherein the cross-linked styrene-acrylic acid-based resin contained in the first resin particles and the cross-linked styrene-acrylic acid-based resin contained in the second resin particles include the same monomer and are made from the same cross-linking agent.

8. The two-component developer according to claim 1, wherein the carrier mother particle includes a carrier core and a coat layer covering a surface of the carrier core.

9. The two-component developer according to claim 1, wherein inorganic particles are attached to the surface of the toner mother particle in addition to the first resin particles, and no inorganic particles are externally added to the surface of the carrier mother particle.

* * * * *